US008536455B2

(12) United States Patent
Gareis et al.

(10) Patent No.: US 8,536,455 B2
(45) **Date of Patent: *Sep. 17, 2013**

(54) HIGH PERFORMANCE DATA CABLE

(75) Inventors: Galen Mark Gareis, Oxford, OH (US); Paul Z Vanderlaan, Oxford, OH (US)

(73) Assignee: Belden Inc., St. Louis, MO (US)

( * ) Notice: Subject to any disclaimer, the term of this patent is extended or adjusted under 35 U.S.C. 154(b) by 201 days.

This patent is subject to a terminal disclaimer.

(21) Appl. No.: 13/174,119

(22) Filed: Jun. 30, 2011

(65) Prior Publication Data

US 2011/0253419 A1 Oct. 20, 2011

Related U.S. Application Data

(63) Continuation of application No. 12/646,657, filed on Dec. 23, 2009, now Pat. No. 7,977,575, which is a continuation of application No. 11/877,343, filed on Oct. 23, 2007, now Pat. No. 7,663,061, which is a continuation of application No. 09/765,914, filed on Jan. 18, 2001, now Pat. No. 7,339,116, which is a continuation-in-part of application No. 09/074,272, filed on May 7, 1998, now Pat. No. 6,222,130, which is a continuation-in-part of application No. 08/629,509, filed on Apr. 9, 1996, now Pat. No. 5,789,711.

(51) Int. Cl.
*H01B 7/00* (2006.01)

(52) U.S. Cl.
USPC ..... 174/110 R; 174/113 R; 174/113 C; 174/115

(58) Field of Classification Search
USPC ..... 174/110 R, 113 R, 113 C, 113 AS, 174/115, 116
See application file for complete search history.

(56) References Cited

U.S. PATENT DOCUMENTS

| | | | |
|---|---|---|---|
| 867,659 | A | 10/1907 | Hoopes et al. |
| 1,008,370 | A | 11/1911 | Robillot |
| 1,132,452 | A | 3/1915 | Davis |

(Continued)

FOREIGN PATENT DOCUMENTS

| | | |
|---|---|---|
| CA | 2058046 A1 | 8/1992 |
| DE | 697378 | 10/1940 |

(Continued)

OTHER PUBLICATIONS

Bell Communications Research TA-TSY-00020, Issue 5, Aug. 1986.

(Continued)

*Primary Examiner* — William H Mayo, III
(74) *Attorney, Agent, or Firm* — Lando & Anastasi, LLP

(57) ABSTRACT

A high performance data cable which has an interior support or star separator. The star separator or interior support extends along the longitudinal length of the data cable. The star separator or interior support has a central region. A plurality of prongs or splines extend outward from the central region along the length of the central region. Each prong or spline is adjacent with at least two other prongs or splines. The prongs or splines may be helixed or S-Z shaped as they extend along the length of the star separator or interior support. Each pair of adjacent prongs or splines defines grooves which extend along the longitudinal length of the interior support. At least two of the grooves have disposed therein an insulated conductor. The interior support can have a first material and a different second material. The different second material forms an outer surface of the interior support.

17 Claims, 3 Drawing Sheets

FIG. 1A

(56) References Cited

U.S. PATENT DOCUMENTS

| | | | | |
|---|---|---|---|---|
| 1,389,143 | A | | 8/1921 | Kempton |
| 1,700,606 | A | | 1/1929 | Beaver |
| 1,940,917 | A | | 12/1933 | Okazaki |
| 1,995,201 | A | | 3/1935 | Delon |
| 2,149,772 | A | | 3/1939 | Hunter et al. |
| 2,218,830 | A | | 10/1940 | Rose et al. |
| 2,501,457 | A | | 3/1950 | Thelin |
| 3,055,967 | A | | 9/1962 | Bondon |
| 3,209,064 | A | | 9/1965 | Cutler |
| 3,259,687 | A | | 7/1966 | Oatess et al. |
| 3,363,047 | A | | 1/1968 | Grove |
| 3,610,814 | A | | 10/1971 | Peacock |
| 3,644,659 | A | | 2/1972 | Campbell |
| 3,888,710 | A | | 6/1975 | Burk |
| 3,921,378 | A | | 11/1975 | Spicer et al. |
| 4,257,675 | A | | 3/1981 | Nakagome et al. |
| 4,361,381 | A | | 11/1982 | Williams |
| 4,385,485 | A | | 5/1983 | Yonechi |
| 4,401,366 | A | | 8/1983 | Hope |
| 4,401,845 | A | | 8/1983 | Odhner et al. |
| 4,446,689 | A | | 5/1984 | Hardin et al. |
| 4,447,122 | A | | 5/1984 | Sutehall |
| 4,456,331 | A | | 6/1984 | Whitehead et al. |
| RE32,225 | E | | 8/1986 | Neuroth et al. |
| 4,645,628 | A | | 2/1987 | Gill |
| 4,661,406 | A | | 4/1987 | Gruhn et al. |
| 4,710,594 | A | | 12/1987 | Walling et al. |
| 4,719,319 | A | * | 1/1988 | Tighe, Jr. ..... 174/103 |
| 4,755,629 | A | | 7/1988 | Beggs et al. |
| 4,784,461 | A | | 11/1988 | Abe et al. |
| 4,784,462 | A | | 11/1988 | Priaroggia |
| 4,807,962 | A | * | 2/1989 | Arroyo et al. ..... 385/105 |
| 4,935,467 | A | | 6/1990 | Cheng et al. |
| 5,000,539 | A | | 3/1991 | Gareis |
| 5,010,210 | A | | 4/1991 | Sidi et al. |
| 5,087,110 | A | | 2/1992 | Inagaki et al. |
| 5,132,488 | A | * | 7/1992 | Tessier et al. ..... 174/34 |
| 5,149,915 | A | | 9/1992 | Brunker et al. |
| 5,162,609 | A | | 11/1992 | Adriaenssens et al. |
| 5,212,350 | A | | 5/1993 | Gebs |
| 5,227,417 | A | | 7/1993 | Kroushl, III |
| 5,355,427 | A | | 10/1994 | Gareis et al. |
| 5,399,813 | A | | 3/1995 | McNeill et al. |
| 5,424,491 | A | | 6/1995 | Walling et al. |
| 5,486,649 | A | | 1/1996 | Gareis |
| 5,557,698 | A | | 9/1996 | Gareis et al. |
| 5,574,250 | A | * | 11/1996 | Hardie et al. ..... 174/36 |
| 5,600,097 | A | | 2/1997 | Bleich et al. |
| 5,670,748 | A | | 9/1997 | Gingue et al. |
| 5,696,295 | A | * | 12/1997 | Wulff et al. ..... 568/724 |
| 5,699,467 | A | | 12/1997 | Kojima et al. |
| 5,763,823 | A | | 6/1998 | Siekierka et al. |
| 5,789,711 | A | | 8/1998 | Gaeris et al. |
| 5,883,334 | A | | 3/1999 | Newmoyer et al. |
| 5,952,615 | A | * | 9/1999 | Prudhon ..... 174/113 C |
| 6,074,503 | A | | 6/2000 | Clark et al. |
| 6,091,025 | A | | 7/2000 | Cotter et al. |
| 6,099,345 | A | | 8/2000 | Milner et al. |
| 6,140,587 | A | | 10/2000 | Sackett |
| 6,150,612 | A | * | 11/2000 | Grandy et al. ..... 174/113 C |
| 6,162,992 | A | | 12/2000 | Clark et al. |
| 6,211,467 | B1 | | 4/2001 | Berelsman et al. |
| 6,248,954 | B1 | | 6/2001 | Clark et al. |
| 6,288,340 | B1 | | 9/2001 | Arnould |
| 6,300,573 | B1 | | 10/2001 | Horie et al. |
| 6,303,867 | B1 | | 10/2001 | Clark et al. |
| 6,365,836 | B1 | | 4/2002 | Blouin et al. |
| 6,506,976 | B1 | | 1/2003 | Neveux, Jr. |
| 6,570,095 | B2 | | 5/2003 | Clark et al. |
| 6,596,944 | B1 | | 7/2003 | Clark et al. |
| 6,624,359 | B2 | | 9/2003 | Bahlmann et al. |
| 6,639,152 | B2 | | 10/2003 | Glew et al. |
| 6,686,537 | B1 | | 2/2004 | Gareis et al. |
| 6,687,437 | B1 | | 2/2004 | Starnes et al. |
| 6,770,819 | B2 | | 8/2004 | Patel |
| 6,787,697 | B2 | | 9/2004 | Stipes et al. |
| 6,800,811 | B1 | | 10/2004 | Boucino |
| 6,815,611 | B1 | | 11/2004 | Gareis |
| 6,818,832 | B2 | | 11/2004 | Hopkinson et al. |
| 6,855,889 | B2 | | 2/2005 | Gareis |
| 6,888,070 | B1 | | 5/2005 | Prescott |
| 6,897,382 | B2 | | 5/2005 | Hager et al. |
| 6,974,913 | B2 | | 12/2005 | Bahlmann et al. |
| 6,998,537 | B2 | | 2/2006 | Clark et al. |
| 7,049,523 | B2 | | 5/2006 | Shuman et al. |
| 7,064,277 | B1 | | 6/2006 | Lique et al. |
| 7,098,405 | B2 | | 8/2006 | Glew |
| 7,109,424 | B2 | | 9/2006 | Nordin et al. |
| 7,115,815 | B2 | | 10/2006 | Kenny et al. |
| 7,135,641 | B2 | | 11/2006 | Clark |
| 7,145,080 | B1 | | 12/2006 | Boisvert et al. |
| 7,154,043 | B2 | | 12/2006 | Clark |
| 7,173,189 | B1 | | 2/2007 | Hazy et al. |
| 7,179,999 | B2 | | 2/2007 | Clark et al. |
| 7,196,271 | B2 | | 3/2007 | Cornibert et al. |
| 7,208,683 | B2 | | 4/2007 | Clark |
| 7,214,884 | B2 | | 5/2007 | Kenny et al. |
| 7,220,918 | B2 | | 5/2007 | Kenny et al. |
| 7,238,885 | B2 | | 7/2007 | Lique et al. |
| 7,244,893 | B2 | | 7/2007 | Clark |
| 7,271,342 | B2 | | 9/2007 | Stutzman et al. |
| 7,317,163 | B2 | | 1/2008 | Lique et al. |
| 7,329,815 | B2 | | 2/2008 | Kenny et al. |
| 7,339,116 | B2 | | 3/2008 | Gareis |
| 7,358,436 | B2 | | 4/2008 | Dellagala et al. |
| 7,390,971 | B2 | | 6/2008 | Jean et al. |
| 7,405,360 | B2 | | 7/2008 | Clark et al. |
| 7,491,888 | B2 | | 2/2009 | Clark et al. |
| 7,498,518 | B2 | | 3/2009 | Kenny et al. |
| 7,507,910 | B2 | | 3/2009 | Park et al. |
| 7,534,964 | B2 | | 5/2009 | Clark et al. |
| 7,705,244 | B2 | | 4/2010 | Fok |
| 2003/0230427 | A1 | | 12/2003 | Gareis |
| 2004/0050578 | A1 | | 3/2004 | Hudson |
| 2006/0131058 | A1 | | 6/2006 | Lique et al. |
| 2006/0243477 | A1 | | 11/2006 | Jean et al. |
| 2007/0044994 | A1 | | 3/2007 | Park et al. |
| 2007/0209823 | A1 | | 9/2007 | Vexler et al. |
| 2008/0041609 | A1 | | 2/2008 | Gareis et al. |
| 2008/0164049 | A1 | | 7/2008 | Vexler et al. |
| 2009/0133895 | A1 | | 5/2009 | Allen |
| 2009/0173514 | A1 | | 7/2009 | Gareis |

FOREIGN PATENT DOCUMENTS

| | | | |
|---|---|---|---|
| EP | 0802545 | A1 | 10/1997 |
| EP | 1 107 262 | A2 | 6/2000 |
| EP | 1 085 530 | A2 | 3/2001 |
| EP | 1 162 632 | A2 | 12/2001 |
| EP | 1 215 688 | A1 | 6/2006 |
| GB | 342606 | | 2/1931 |
| JP | 1942-10582 | | 9/1942 |
| JP | S29-15973 | | 12/1955 |
| JP | S511976-33331 | | 8/1976 |
| JP | Sho56-1981-7307 | | 1/1981 |
| JP | Sho56-1981-8011 | | 1/1981 |
| JP | Sho61-1986-13507 | | 1/1986 |
| JP | 11-53958 | | 2/1999 |
| JP | 2004311120 | A | 11/2004 |
| WO | 9624143 | A1 | 8/1996 |
| WO | 9848430 | A1 | 10/1998 |
| WO | 0051142 | A1 | 8/2000 |
| WO | 0079545 | A1 | 12/2000 |
| WO | 0108167 | A1 | 2/2001 |
| WO | 0154142 | A1 | 7/2001 |
| WO | 03077265 | A1 | 9/2003 |
| WO | 03094178 | A1 | 11/2003 |
| WO | 2005048274 | A2 | 5/2005 |

OTHER PUBLICATIONS

Hawley, The Condensed Chemical Dictionary, Tenth Edition, 1981, pp. 471, 840, 841.

Refi, James J., Fiber Optic Cable: A Lightguide, AT&T Specialized Series, Jan. 1991, pp. 79-80.
C&M Corporation Engineering Design Guide, 3rd Edition, 1992, p. 11.
Hitachi Cable Manchester, Apr. 23, 1997, pp. 1-5.

* cited by examiner

HIGH PERFORMANCE DATA CABLE

CROSS-REFERENCE TO RELATED APPLICATIONS

This application is a continuation of, and claims priority under 35 U.S.C. §120 to, co-pending U.S. application Ser. No. 12/646,657 entitled "HIGH PERFORMANCE DATA CABLE," filed Dec. 23, 2009, which is a continuation of, and claims to U.S. application Ser. No. 11/877,343 entitled "HIGH PERFORMANCE DATA CABLE," filed Oct. 23, 2007 now U.S. Pat. No. 7,663,061, which is a continuation of, and claims priority to, U.S. application Ser. No. 09/765,914 entitled "HIGH PERFORMANCE DATA CABLE," filed Jan. 18, 2001 now U.S. Pat. No. 7,339,116, which is a continuation-in-part of, and claims priority to, U.S. application Ser. No. 09/074,272 entitled "HIGH PERFORMANCE DATA CABLE," filed May 7, 1998 now U.S. Pat. No. 6,222,130, which is a continuation-in-part of, and claims priority to, U.S. application Ser. No. 08/629,509 entitled "HIGH PERFORMANCE DATA CABLE," filed Apr. 9, 1996 now U.S. Pat. No. 5,789,711. Each of the above-identified patents and patent applications is herein incorporated by reference in its entirety.

FIELD OF INVENTION

This invention relates to a high performance data cable utilizing twisted pairs. The data cable has an interior support or star separator around which the twisted pairs are disposed.

BACKGROUND OF THE INVENTION

Many data communication systems utilize high performance data cables having at least four twisted pairs. Typically, two of the twisted pairs transmit data and two of the pairs receive data. A twisted pair is a pair of conductors twisted about each other. A transmitting twisted pair and a receiving twisted pair often form a subgroup in a cable having four twisted pairs.

A high performance data cable utilizing twisted pair technology must meet exacting specifications with regard to data speed and electrical characteristics. The electrical characteristics include such things as controlled impedance, controlled near-end cross-talk (NEXT), controlled ACR (attenuation minus cross-talk) and controlled shield transfer impedance.

One way twisted pair data cables have tried to meet the electrical characteristics, such as controlled NEXT, is by utilizing individually shielded twisted pairs (ISTP). These shields insulate each pair from NEXT. Data cables have also used very complex lay techniques to cancel E and B fields to control NEXT. Finally, previous data cables have tried to meet ACR requirements by utilizing very low dielectric constant insulations. The use of the above techniques to control electrical characteristics has problems.

Individual shielding is costly and complex to process. Individual shielding is highly susceptible to geometric instability during processing and use. In addition, the ground plane of individual shields, 360.degree. in ISTP's, lessens electrical stability.

Lay techniques are also complex, costly and susceptible to instability during processing and use.

Another problem with many data cables is their susceptibility to deformation during manufacture and use. Deformation of the cable's geometry, such as the shield, lessens electrical stability. Applicant's unique and novel high performance data cable meets the exacting specifications required of a high performance data cable while addressing the above problems.

This novel cable has an interior support with grooves. Each groove accommodates at least one signal transmission conductor. The signal transmission conductor can be a twisted pair conductor or a single conductor. The interior support provides needed structural stability during manufacture and use. The grooves also improve NEXT control by allowing for the easy spacing of the twisted pairs. The easy spacing lessens the need for complex and hard to control lay procedures and individual shielding.

The interior support allows for the use of a single overall foil shield having a much smaller ground plane than individual shields. The smaller ground plane improves electrical stability. For instance, the overall shield improves shield transfer impedance. The overall shield is also lighter, cheaper and easier to terminate than ISTP designs.

The interior support can have a first material and a different second material. The different second material forms the outer surface of the interior support and thus forms the surface defining the grooves. The second material is generally a foil shield and helps to control electricals between signal transmission conductors disposed in the grooves. The second material, foil shield, is used in addition to the previously mentioned overall shield.

This novel cable produces many other significant advantageous results such as: improved impedance determination because of the ability to precisely place twisted pairs; the ability to meet a positive ACR value from twisted pair to twisted pair with a cable that is no larger than an ISTP cable; and an interior support which allows for a variety of twisted pair dimensions.

Previous cables have used supports designed for coaxial cables. The supports in these cables are designed to place the center conductor coaxially within the outer conductor. The supports of the coaxial designs are not directed towards accommodating signal transmission conductors. The slots in the coaxial support remain free of any conductor. The slots in the coaxial support are merely a side effect of the design's direction to center a conductor within an outer conductor with a minimal material cross section to reduce costs. In fact, one would really not even consider these coaxial cable supports in concurrence with twisted pair technology.

SUMMARY OF THE INVENTION

In one embodiment, we provide a data cable which has a one piece plastic interior support. The interior support extends along the longitudinal length of the data cable. The interior support has a central region which extends along the longitudinal length of the interior support. The interior support has a plurality of prongs. Each prong is integral with the central region. The prongs extend along the longitudinal length of the central region and extend outward from the central region. The prongs are arranged so that each prong of said plurality is adjacent with at least two other prongs.

Each pair of adjacent prongs define a groove extending along the longitudinal length of the interior support. The prongs have a first and second lateral side. A portion of the first lateral side and a portion of the second lateral side of at least one prong converge towards each other.

The cable further has a plurality of insulated conductors disposed in at least two of the grooves.

A cable covering surrounds the interior support. The cable covering is exterior to the conductors.

Applicant's inventive cable can be alternatively described as set forth below. The cable has an interior support extending along the longitudinal length of the data cable. The interior support has a central region extending along the longitudinal length of the interior support. The interior support has a plurality of prongs. Each prong is integral with the central region. The prongs extend along the longitudinal length of the central region and extend outward from the central region. The prongs are arranged so that each prong is adjacent with at least two other prongs.

Each prong has a base. Each base is integral with the central region. At least one of said prongs has a base which has a horizontal width greater than the horizontal width of a portion of said prong above said base. Each pair of the adjacent prongs defines a groove extending along the longitudinal length of the interior support.

A plurality of conductors is disposed in at least two of said grooves.

A cable covering surrounds the interior support. The cable covering is exterior to the conductors.

The invention can further be alternatively described by the following description. An interior support for use in a high-performance data cable. The data cable has a diameter of from about 0.300" to about 0.400". The data cable has a plurality of insulated conductor pairs.

The interior support in said high-performance data cable has a cylindrical longitudinally extending central portion. A plurality of splines radially extend from the central portion. The splines also extend along the length of the central portion. The splines have a triangular cross-section with the base of the triangle forming part of the central portion, each triangular spline has the same radius. Adjacent splines are separated from each other to provide a cable chamber for at least one pair of conductors. The splines extend longitudinally in a helical, S, or Z-shaped manner.

An alternative embodiment of applicant's cable can include an interior support having a first material and a different second material. The different second material forms an outer surface of the interior support. The second material conforms to the shape of the first material. The second material can be referred to as a conforming shield because it is a foil shield which conforms to the shape defined by the outer surface of the first material.

Accordingly, the present invention desires to provide a data cable that meets the exacting specifications of high performance data cables, has a superior resistance to deformation during manufacturing and use, allows for control of near-end cross talk, controls electrical instability due to shielding, and can be a 300 MHz cable with a positive ACR ratio.

It is still another desire of the invention to provide a cable that does not require individual shielding, and that allows for the precise spacing of conductors such as twisted pairs with relative ease.

It is still a further desire of the invention to provide a data cable that has an interior support that accommodates a variety of AWG's and impedances, improves crush resistance, controls NEXT, controls electrical instability due to shielding, increases breaking strength, and allows the conductors such as twisted pairs to be spaced in a manner to achieve positive ACR ratios.

Other desires, results, and novel features of the present invention will become more apparent from the following drawing and detailed description and the accompanying claims.

DETAILED DESCRIPTION

The following description will further help to explain the inventive features of this cable.

Figure 1:
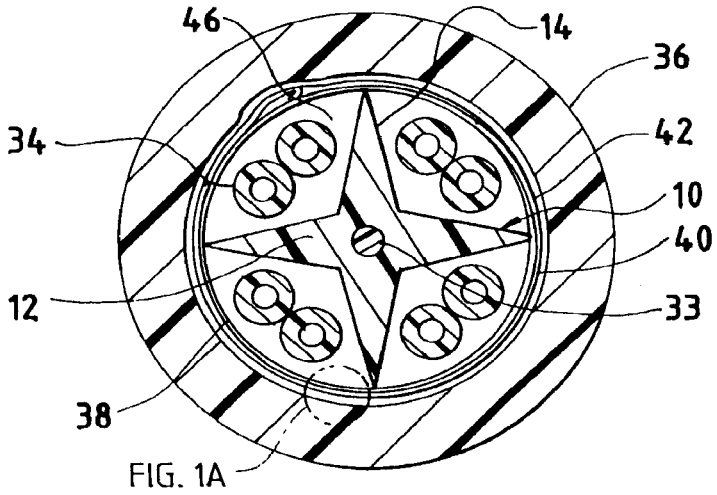
FIG. 1 is a vertical cross-sectional view taken along a plane of one embodiment of this invention.
Figure 1A:
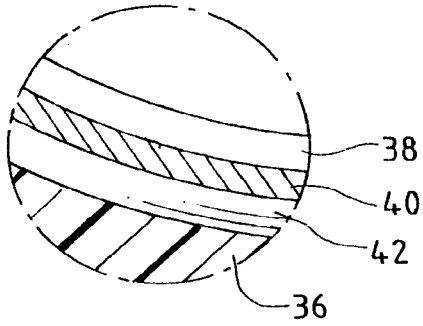
FIG. 1*a* is a blow up of a portion of the cross section shown in FIG. 1.
Figure 2:
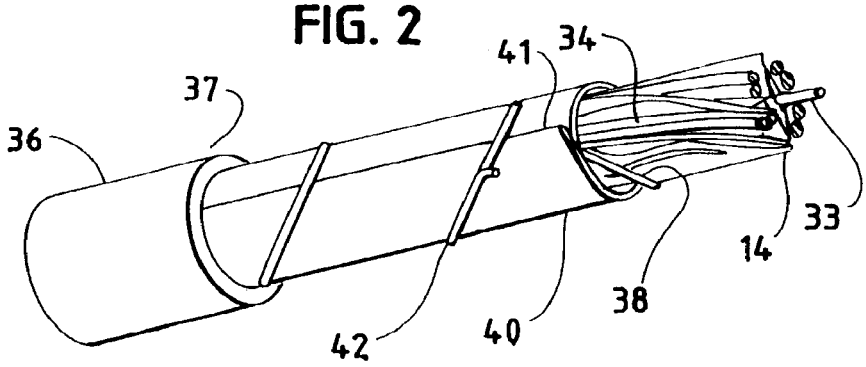
FIG. 2 is a top right perspective view of this invention. The view shows the cable cut away to expose its various elements. The view further shows the helical twist of the prongs or splines.

FIG. 1 is a vertical cross-section of one embodiment of this novel cable. The shown embodiment has an interior support or star separator (10). The interior support or star separator runs along the longitudinal length of the cable as can be seen in FIG. 2. The interior support or star separator, hereinafter, in the detailed description, both referred to as the "star separator", has a central region (12) extending along the longitudinal length of the star separator. The star separator has four prongs or splines. Each prong or spline (14), hereinafter in the detailed description both referred to as splines, extends outward from the central region and extends along the longitudinal length of the central region. The splines are integral with the central region. Each spline has a base portion (15). Each base portion is integral with the central region. Each spline has a base portion which has a horizontal width greater than the horizontal width of a portion of said spline above said base.

Each spline also has a first lateral side (16) and a second lateral side (17). The first and second lateral sides of each spline extend outward from the central region and converge towards each other to form a top portion (18). Each spline has a triangular cross section with preferably an isosceles triangle cross section. Each spline is adjacent with at least two other splines. For instance, spline (14) is adjacent to both adjacent spline (20) and adjacent spline (21).

The first lateral side of each spline is adjacent with a first or a second lateral side of another adjacent spline. The second lateral side of each spline is adjacent to the first or second side of still another adjacent spline.

Figure 3:
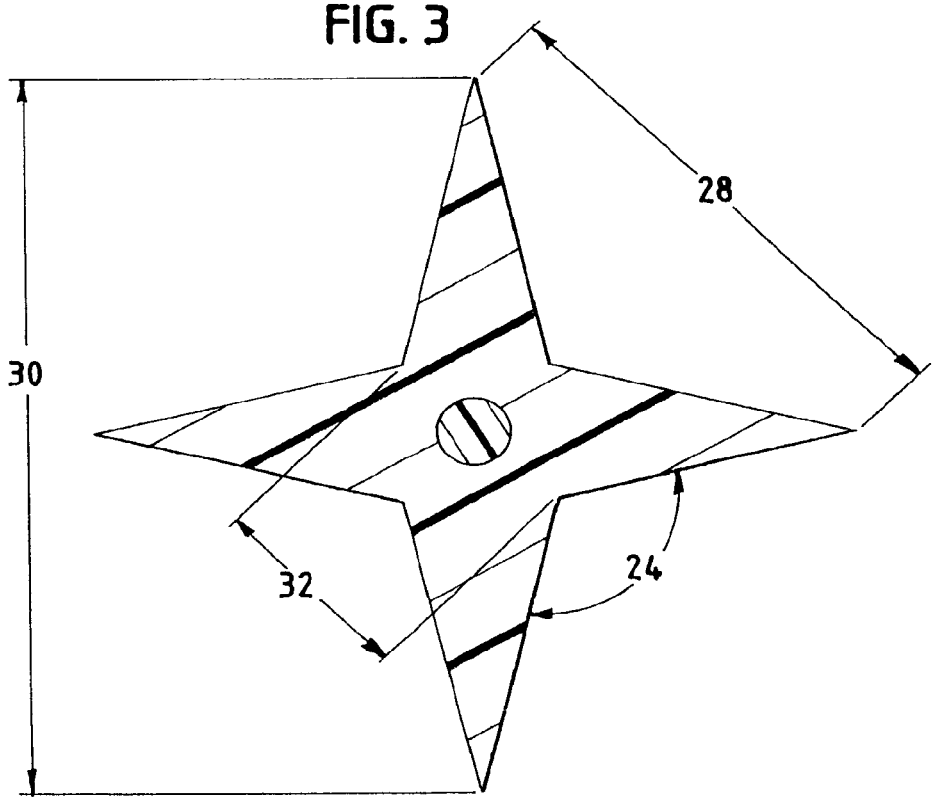
FIG. 3 is a vertical cross-section of the interior support or star separator showing some of the dimensions of the interior support or star separator.
Figure 4:
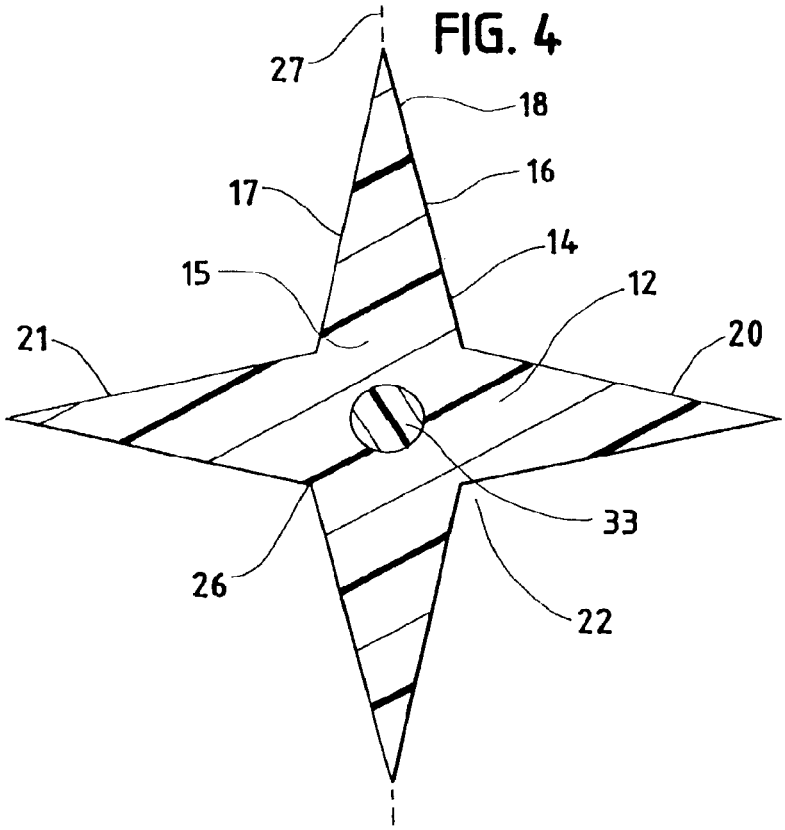
FIG. 4 is a vertical cross-section of the interior or star separator support showing the features of the prongs or splines.

Each pair of adjacent splines defines a groove (22). The angle (24) of each groove is greater than 90°. The adjacent sides are angled towards each other so that they join to form a crevice (26). The groove extends along the longitudinal length of the star separator. The splines are arranged around the central region so that a substantial congruency exists along a straight line (27) drawn through the center of the horizontal cross section of the star separator. Further, the splines are spaced so that each pair of adjacent splines has a distance (28), measured from the center of the top of one spline to the center of the top of an adjacent spline (top to top distance) as shown in FIG. 3. The top to top distance (28) being substantially the same for each pair of adjacent splines.

In addition, the shown embodiment has a preferred "tip to crevice" ratio of between about 2.1 and 2.7. Referring to FIG. 3, the "tip distance" (30) is the distance between two top portions opposite each other. The "crevice distance" (32) is the distance between two crevices opposite each other. The ratio is measured by dividing the "tip" distance by the "crevice" distance.

The specific "tip distance," "crevice distance" and "top to top" distances can be varied to fit the requirements of the user such as various AWG's and impedances. The specific material for the star separator also depends on the needs of the user such as crush resistance, breaking strengths, the need to use gel fillings, the need for safety, and the need for flame and smoke resistance. One may select a suitable copolymer. The star separator is solid beneath its surface.

A strength member may be added to the cable. The strength member (33) in the shown embodiment is located in the central region of the star separator. The strength member runs the longitudinal length of the star separator. The strength member is a solid polyethylene or other suitable plastic, textile (nylon, aramid, etc.), fiberglass (FGE rod), or metallic material.

Conductors, such as the shown insulated twisted pairs, (34) are disposed in each groove. The pairs run the longitudinal length of the star separator. The twisted pairs are insulated with a suitable copolymer. The conductors are those normally used for data transmission. The twisted pairs may be Belden's DATATWIST 350 twisted pairs. Although the embodiment utilizes twisted pairs, one could utilize various types of insulated conductors with the star separator.

The star separator may be cabled with a helixed or S-Z configuration. In a helical shape, the splines extend helically along the length of the star separator as shown in FIG. 2. The helically twisted splines in turn define helically twisted conductor receiving grooves which accommodate the twisted pairs.

The cable (37) as shown in FIG. 2 is a high performance shielded 300 MHz data cable. The cable has an outer jacket (36), e.g., polyvinyl chloride.

Over the star separator is a polymer binder sheet (38). The binder is wrapped around the star separator to enclose the twisted pairs. The binder has an adhesive on the outer surface to hold a laterally wrapped shield (40). The shield (40) is a tape with a foil or metal surface facing towards the interior of the jacket. The shield in the shown embodiment is of foil and has an overbelt (shield is forced into round smooth shape) (41) which may be utilized for extremely well controlled electricals. A metal drain wire (42) is spirally wrapped around the shield. The drain spiral runs the length of the cable. The drain functions as a ground.

My use of the term "cable covering" refers to a means to insulate and protect my cable. The cable covering being exterior to said star member and insulated conductors disposed in said grooves. The outer jacket, shield, drain spiral and binder described in the shown embodiment provide an example of an acceptable cable covering. The cable covering, however, may simply include an outer jacket.

Figure 5:
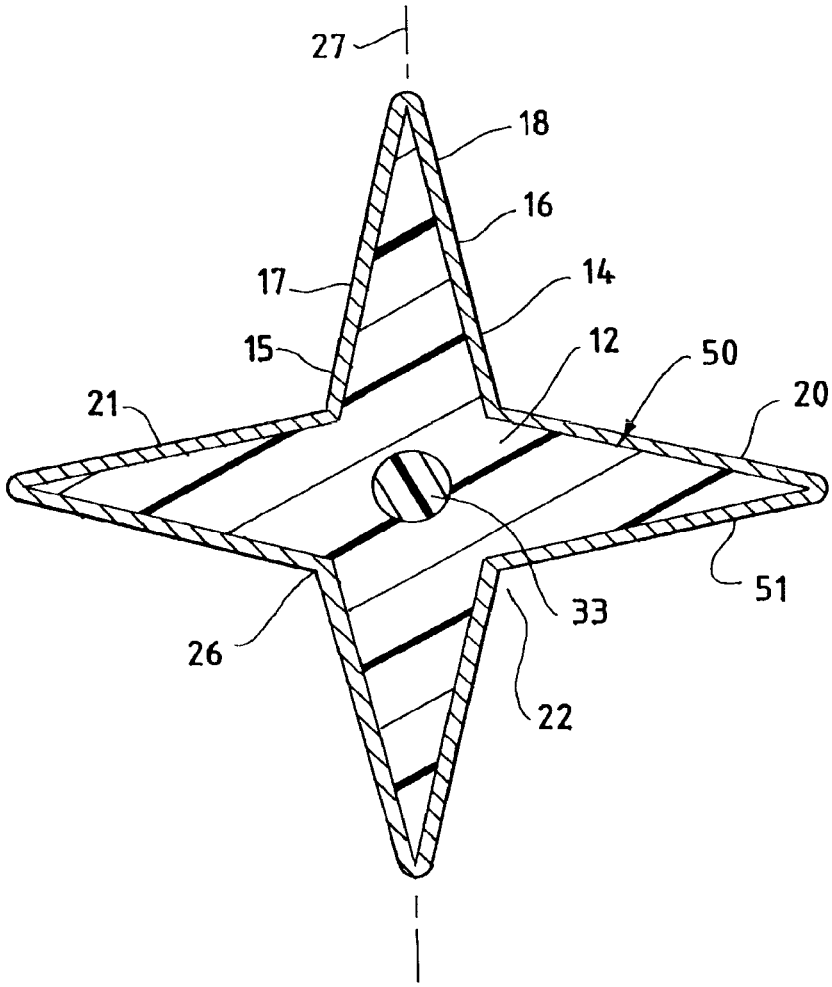
FIG. 5 is a vertical cross-section of an alternative embodiment of an interior support or star separator showing the conforming foil shield which makes up the second material of the interior support.

The cable may also include a gel filler to fill the void space (46) between the interior support, twisted pairs and a part of the cable covering.

alternative embodiment of the cable utilizes an interior support having a first inner material (50) and a different second outer material (51) (see FIG. 5). The second material is a conforming shield which conforms to the shape defined by the outer surface of the first material (50). The conforming shield is a foil shield. The foil shield should have enough thickness to shield the conductors from each other. The shield should also have sufficient thickness to avoid rupture during conventional manufacture of the cable or during normal use of the cable. The thickness of the conforming shield utilized was about 3 mm. The thickness could go down to even 0.3 mm. Further, although the disclosed embodiment utilizes a foil shield as the conforming shield, the conforming shield could alternatively be a conductive coating applied to the outer surface of the first material (50).

To conform the foil shield (51) to the shape defined by the first material's (50) outer surface, the foil shield (51) and an already-shaped first material (50) are placed in a forming die. The forming die then conforms the shield to the shape defined by the first material's outer surface.

The conforming shield can be bonded to the first material. An acceptable method utilizes heat pressure bonding. One heat pressure bonding technique requires utilizing a foil shield with an adhesive vinyl back. The foil shield, after being conformed to the shape defined by the first material's outer surface, is exposed to heat and pressure. The exposure binds the conforming shield (51) to the outer surface of the first material (50).

A cable having an interior support as shown in FIG. 5 is the same as the embodiment disclosed in FIG. 1 except the alternative embodiment in FIG. 5 includes the second material, the conforming shield (51), between the conductors and the first material (50).

The splines of applicant's novel cable allow for precise support and placement of the twisted pairs. The star separator will accommodate twisted pairs of varying AWG's and impedance. The unique triangular shape of the splines provides a geometry which does not easily crush.

The crush resistance of applicant's star separator helps preserve the spacing of the twisted pairs, and control twisted pair geometry relative to other cable components. Further, adding a helical or S-Z twist improves flexibility while preserving geometry.

The use of an overall shield around the star separator allows a minimum ground plane surface over the twisted pairs, about 45° of covering. The improved ground plane provided by applicant's shield, allows applicant's cable to meet a very low transfer impedance specification. The overall shield may have a more focused design for ingress and egress of cable emissions and not have to focus on NEXT duties.

The strength member located in the central region of the star separator allows for the placement of stress loads away from the pairs.

It will, of course, be appreciated that the embodiment which has just been described has been given by way of illustration, and the invention is not limited to the precise embodiments described herein; various changes and modifications may be effected by one skilled in the art without departing from the scope or spirit of the invention as defined in the appended claims.

What is claimed is:

1. A high performance data communications cable comprising:

a non-conductive interior support formed of a copolymer and having a longitudinally extending central portion and a plurality of arms radially extending from the central portion along the length of the central portion, each arm of the plurality of arms being adjacent to two other arms of the plurality of arms, the plurality of arms forming a plurality of pairs of adjacent arms, the plurality of pairs of adjacent arms defining a corresponding plurality of grooves;

a plurality of twisted pair conductors configured to carry data communications signals, only one twisted pair of the plurality of twisted pairs being respectively located in each groove of the plurality of grooves; and a cable covering surrounding the plurality of twisted pairs and the interior support along a length of the cable;

wherein the interior support is configured in combination with the cable covering to maintain the plurality of twisted pairs within the grooves defined by the plurality of pairs of adjacent arms of the interior support; and wherein the plurality of twisted pair conductors and the interior support are helically twisted together about a common central axis to close the cable.

2. The high performance data communications cable of claim 1, wherein the longitudinally extending central portion of the interior support is cylindrical.

3. The high performance data communications cable of claim 1, wherein the cable covering includes an overall shield.

4. The high performance data communications cable of claim 3, wherein the shield includes a lateral fold, the shield being supported by the plurality of arms, the shield and the plurality of pairs of adjacent arms defining a plurality of at least four conductor compartments in which the plurality of twisted pair conductors are individually disposed.

5. The high performance data communications cable of claim 1, wherein the interior support consists of at least one dielectric material.

6. The high performance data communications cable of claim 1, wherein the cable covering consists of an outer jacket, the outer jacket being formed of a non-conductive material.

7. The high performance data communications cable of claim 6, wherein the outer jacket comprises polyvinyl chloride.

8. The high performance data communications cable of claim 6, wherein the cable is unshielded and does not include an electrically conductive shield between the outer jacket and the twisted pair conductors and the interior support.

9. The high performance data communications cable of claim 1, wherein the cable covering contacts each arm of the interior support.

10. The high performance data communications cable of claim 1, wherein each arm has a non-uniform width.

11. The high performance data communications cable of claim 1, wherein in the plurality of arms, each arm having a first and second lateral side, and a portion of the first lateral side and a portion of the second lateral side of at least one of the arms converging towards each other.

12. The high performance data communications cable of claim 1, wherein each arm of the plurality of arms has a base that is integral with the central portion of the interior support, a tip, a first lateral side, and a second lateral side, the first lateral side and the second lateral side extending from the base to the tip of the arm, the first and second lateral sides converging toward one another from the base to the tip of the arm.

13. The high performance data communications cable of claim 1, wherein the plurality of twisted pair conductors consists of four twisted pair conductors, and wherein the plurality of arms consists of four arms.

14. The high performance data communications cable of claim 1, wherein the interior support is solid beneath its surface.

15. The high performance data communications cable of claim 1, wherein the interior support is configured to define a cavity in the central portion, the cable further comprising a strength member disposed within the cavity along the length of the central portion.

16. The high performance data communications cable of claim 1, wherein the cable covering includes a polymer binder sheet wrapped around the interior support to enclose the plurality of twisted pair conductors.

17. The high performance data communications cable of claim 1, further comprising a gel filler filling a void space within the cable between the interior support, the plurality of twisted pair conductors and the cable covering.

* * * * *